US007784654B1

(12) United States Patent
Mercado

(10) Patent No.: US 7,784,654 B1
(45) Date of Patent: Aug. 31, 2010

(54) COLLAPSIBLE TRAVEL HANGER

(76) Inventor: Geraldo Mercado, 1776 Castle Hill Ave., Apt. 1E, Bronx, NY (US) 10462

( * ) Notice: Subject to any disclaimer, the term of this patent is extended or adjusted under 35 U.S.C. 154(b) by 47 days.

(21) Appl. No.: 12/075,012

(22) Filed: Mar. 7, 2008

(51) Int. Cl.
*A41D 27/22* (2006.01)

(52) U.S. Cl. ..... 223/89; 223/94

(58) Field of Classification Search ..... 223/85, 223/88, 89, 90, 92, 94, 95
See application file for complete search history.

(56) References Cited

U.S. PATENT DOCUMENTS

| | | | | | |
|---|---|---|---|---|---|
| 424,275 | A | * | 3/1890 | Coles et al. | 223/89 |
| 952,202 | A | * | 3/1910 | Klingenfeld | 223/89 |
| 1,101,088 | A | * | 6/1914 | Olson | 223/89 |
| 1,278,054 | A | * | 9/1918 | Strand | 223/89 |
| 1,370,713 | A | * | 3/1921 | Strand | 223/89 |
| 1,448,139 | A | * | 3/1923 | McGinnis | 223/89 |
| 2,413,221 | A | * | 12/1946 | Elston | 223/89 |
| 2,425,527 | A | * | 8/1947 | Gaudino | 223/94 |
| 2,544,170 | A | * | 3/1951 | Mills | 223/89 |
| 2,630,253 | A | * | 3/1953 | Trent | 223/89 |
| 4,669,642 | A | * | 6/1987 | Nicholas | 223/94 |
| 4,793,399 | A | | 12/1988 | Pryor | |
| 4,997,115 | A | * | 3/1991 | Jolley | 223/89 |
| 5,480,076 | A | * | 1/1996 | Siegel et al. | 223/94 |
| 5,632,422 | A | * | 5/1997 | Csengeri | 223/89 |
| 5,687,888 | A | * | 11/1997 | Chang | 223/94 |
| 5,893,493 | A | | 4/1999 | Noiray | |
| 6,328,187 | B2 | * | 12/2001 | Sugita | 223/94 |
| 6,340,104 | B1 | * | 1/2002 | Saylor | 223/94 |
| 6,427,882 | B1 | | 8/2002 | Harvey | |
| 6,540,121 | B1 | | 4/2003 | Harvey | |
| 6,722,538 | B1 | | 4/2004 | Autry et al. | |
| D508,614 | S | * | 8/2005 | Colon | D6/318 |
| 7,185,795 | B1 | | 3/2007 | Wallick | |

* cited by examiner

*Primary Examiner*—Gary L Welch
*Assistant Examiner*—Nathan E Durham
(74) *Attorney, Agent, or Firm*—Montgomery Patent and Design; Robert C. Montgomery; Joseph T. Yaksich

(57) ABSTRACT

A collapsible clothes hanger particularly for use while traveling comprises upper and lower segments of a triangular-shaped hanger hingedly attached thereto each other with a hinge. This hinge allows the hanger to fold in half to a collapsed state. Because the hanger apparatus conveniently fits in a suitcase, it is ideal for travel. To unfold to a deployed state, the lower segment is opened and locked in place. An alternate embodiment is adapted to accept multiple articles of clothing.

12 Claims, 4 Drawing Sheets

COLLAPSIBLE TRAVEL HANGER

FIELD OF THE INVENTION

The present invention relates generally to a collapsible hanger assembly for hanging articles of apparel in an orderly fashion, particularly suited for those who travel frequently.

BACKGROUND OF THE INVENTION

Over the past few years nearly 4 billon trips have been made, on average, in the United States. Of these trips, about 37% was travel for visiting friends/relatives, outdoor recreation, entertainment/sightseeing, or other pleasure/personal reasons. About 13% was travel for business; either general reasons (e.g., consulting, service) or to attend a convention/conference/seminar or for combined business and pleasure purposes.

Everyone is familiar with the hassles of travel. Itineraries must be developed, reservations must be made and contingencies must be planned. But perhaps the biggest source of frustration is that of packing. Not only must clothing be carefully chosen and folded, but upon arrival at your destination, everything must be removed from the suitcase and hung upon hangers. A hotel room will typically provide a small quantity of hangers in which guests can hang all of their clothing. Depending on the length of the stay and the number of individuals in the party, the clothes may be hung for an extended period of time and perhaps for more than one person. Obviously such a quantity is inadequate for any serious type of use. This forces the traveler to double-hang items, or perhaps leave some clothing articles in the suitcase where they will become creased and wrinkled. While a traveler can pack additional hangers in their suitcase before leaving for their destination, typical hangers are large, bulky and unwieldy. They take up an inordinate amount of space in the suitcase and thus limit what additional items the traveler can bring.

No traveler wants to spend time pressing clothes when they should be relaxing, taking in the sights or attending meetings. Accordingly, there exists a need for a means by which travelers can keep their clothing from becoming wrinkled during travel while being assured an adequate supply of hangers once they arrive at their destination without the disadvantages mentioned above. The development of the present invention for will serve to alleviate these concerns.

The present invention describes a device and method to conveniently hang clothing while traveling. Hotel rooms typically provide a small quantity of hangers, usually of an inadequate quantity for hanging clothing. This may cause the traveler to double hang items, or perhaps leave some clothing articles in the suitcase where they will become creased and wrinkled. Packing additional hangers in a suitcase is impractical due to the large size, bulkiness and unwieldy nature of the hangers. Accordingly, there exists a need for a means by which travelers can be provided with an adequate supply of hangers at temporary destinations without the disadvantages as mentioned above. The development of the invention herein described fulfills this need.

U.S. Pat. No. 7,185,795 issued to Wallick discloses a collapsible hanger for suspending clothes and other items. This patent does not appear to disclose a collapsible hanger that collapses in a manner similar to the described invention.

U.S. Pat. No. 6,722,538 issued to Autry and Autry discloses an adjustable clothes hanger. This patent does not appear to disclose a collapsible hanger for traveling.

U.S. Pat. No. 6,540,121 issued to Harvey discloses a collapsible garment hanger. This patent does not appear to disclose a hanger capable of carrying garments such as trousers, nor does it appear to be collapsible in a manner similar to the described invention.

U.S. Pat. No. 6,427,882 issued to Harvey discloses a collapsible garment hanger. This patent does not appear to disclose a hanger capable of carrying garments such as trousers, nor does it appear to be collapsible in a manner similar to the described invention.

U.S. Pat. No. 5,893,493 issued to Noiray discloses a foldable clothes hanger. This patent does not appear to disclose a collapsible hanger that collapses in a manner similar to the described invention.

U.S. Pat. No. 4,793,399 issued to Pryor discloses a hanger assembly. This patent does not appear to disclose a collapsible travel hanger capable of maintaining and holding garments.

The prior art appears to disclose travel hangers that collapse in a vertical manner and mainly hold shirts and similar garments. The prior art does not appear to disclose a collapsible travel hanger that collapses in a horizontal manner, that maintains multiple pieces of wearing apparel in a neat fashion.

SUMMARY OF THE INVENTION

In view of the foregoing disadvantages inherent in the prior art, it has been observed that there is need for a travel hanger that collapses easily and occupies a small portion of the limited space in travel bags.

The collapsible travel hanger provides a convenient device and method of storing clothing hangers when not in use.

The collapsible travel hanger possesses an overall triangular shape, a "J"-shaped hook on top, and upper and lower segments comprising integral pivoting hinges that permit the device to fold in half to a collapsed state. In this manner, the device is ideal for travel, as it can be easily stowed in a suitcase.

The pivot portions of the device provide molded-in appendages and detent features to secure a rotary position once the device is extended.

The collapsible travel hanger comprises a first hinge assembly, a second hinge assembly, a hook, a shaft, a first loop, and a second loop. A first and a second loop each provide a hinging attachment thereto one another at an upper and lower position via a first hinge assembly and a second hinge assembly, respectively.

The collapsible travel hanger provides a clothes support means similar to a conventional plastic clothes hanger comprising a generally triangular shape made up of the hook, the shaft and the loops.

The first hinge assembly further comprises a first pivot member and second pivot member integrally molded thereinto upper ends of the first and second loops. The first and second pivot members comprise a pair of torus-shaped features being stacked thereupon one another along a diametrical surface and aligned about a common vertical axis, the second pivot member being located at an upper position.

The first and second pivot members provide a latching means thereto one another via a first pivot appendage and a first pivot detent along a perimeter edge providing compact collapsible storage and locking deployment of the device. The first pivot appendage comprises a generally hemi-spherical protrusion projecting upward approximately one-quarter (¼) inch high and one-quarter (¼) inch in diameter.

The first pivot detent comprises a female feature which geometrically corresponds to the first pivot appendage fitting snugly therewithin when the device is in the deployed and extended state as shown here.

The shaft comprises a collapsing vertical rod-shaped member inserted slidingly therewithin a first pivot aperture integrally molded thereon the first pivot member at a top central location. The shaft extends from said first pivot member in an upward direction through the second pivot aperture forming a vertical axle, thereby providing a horizontal locating means to the second pivot member during use.

The shaft continues to extend in an upward direction forming an arcuate hook taking a form similar to that of common clothes hangers.

The second hinge assembly comprises a third pivot member and a forth pivot member being integrally molded thereto lower ends of the first and second loops, respectively. The third and fourth pivot members comprise similar design and function as the first and second pivot member portions of the first hinge assembly.

The third pivot member comprises an integrally molded pivot post which provides a vertical axle means to the forth pivot member via a third pivot aperture, thereby functioning in a similar manner as the shaft portion of the first hinge assembly and the second pivot aperture.

The collapsible travel hanger pivot post may provide a snapping feature at a top location providing a secure attachment of the fourth pivot member. The third and fourth pivot members comprise a second pivot appendage and interlocking second pivot detent, respectively, being of like design and function as the previously described first pivot appendage and first pivot detent.

The collapsible travel hanger permits the first loop and hook portions of the device to be rotated one hundred-eighty degrees (180°)until adjacent to the second loop as the corresponding second loop creating a flat configuration that permits convenient storage within a suitcase.

The collapsible travel hanger may be constructed of durable plastic material, such as but not limited to polypropylene, polyethylene and polyvinyl chloride (PVC).

The collapsible travel hanger shaft may be lowered or collapsed further providing a compact storage means. The shaft comprises an integrally molded shaft lock feature at a bottom end. The shaft lock feature comprises a cylindrical form providing a vertical and rotary positioning means to the shaft and hook when extended upward during use. The shaft lock feature is to fit snuggly within a corresponding female feature along a lower surface of the first pivot member.

The collapsible travel hanger, in an alternate embodiment, provides for a multiple clothes hanging capacity. In this embodiment, the device comprises a first multiple loop, a second multiple loop, a plurality of lower pivot members and a plurality of upper pivot members.

The multiple hanger embodiment is suited to hanging a plurality of personal clothing articles such as pants or the like thereupon in conjunction with a single jacket or shirt.

The multiple loops are similar to the aforementioned first and second loops comprising additional attachments thereto lower horizontal rung portions. The multiple hanger embodiment may be provided with any number rungs. Otherwise, the multiple hanger embodiment provides similar locking and folding functionality and is made using similar materials and processes as the preferred embodiment.

The collapsible travel hanger may be used by performing the following steps: assembling the device by inserting the hook portion in the second pivot aperture; inserting the pivot post therein the third pivot aperture; storing one (1) or more devices in a collapsed state within one's suitcase or other travel container until reaching one's destination; deploying the device by rotating the first and second loops into a planar relationship; engaging the first and second pivot appendages therein the first and second pivot detents, respectively, to secure the device in the deployed state; hanging personal clothing articles such as a shirt , jacket, or the like over the device; hanging additional clothing articles such as pants thereonto a lower portion of said loops; or in the alternate multiple hanging embodiment hanging as many articles as desired on the available first and second multiple loops; dispensing clothing articles in an expected manner as needed; collapsing the device for storage purposes by lifting the second loop to disengage the first and second pivot appendages therefrom the first and second pivot detents, respectively, and pivoting the first loop portion horizontally until in contact with said second loop; storing the device in a suitcase or other travel container until needed again; and, benefiting from the compact storage capability of the device, or multiple devices afforded a user while traveling.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | collapsible travel hanger for shirts and pants |
| 20 | upper hinge assembly |
| 25 | lower hinge assembly |
| 27 | first pivot aperture |
| 30 | first pivot member |
| 31 | first pivot appendage |
| 35 | second pivot member |
| 36 | first pivot detent |
| 37 | second pivot aperture |
| 40 | third pivot member |
| 41 | second pivot appendage |
| 42 | pivot post |
| 45 | fourth pivot member |
| 46 | second pivot detent |
| 47 | third pivot aperture |
| 50 | hook |
| 51 | shaft |
| 52 | first loop |
| 53 | second loop |
| 54 | shaft lock feature |
| 60 | multiple hanger embodiment |
| 61 | first multiple loop |
| 62 | second multiple loop |
| 63 | lower pivot member |
| 64 | upper pivot member |

DETAILED DESCRIPTION OF THE PREFERRED EMBODIMENT

Figure 1:
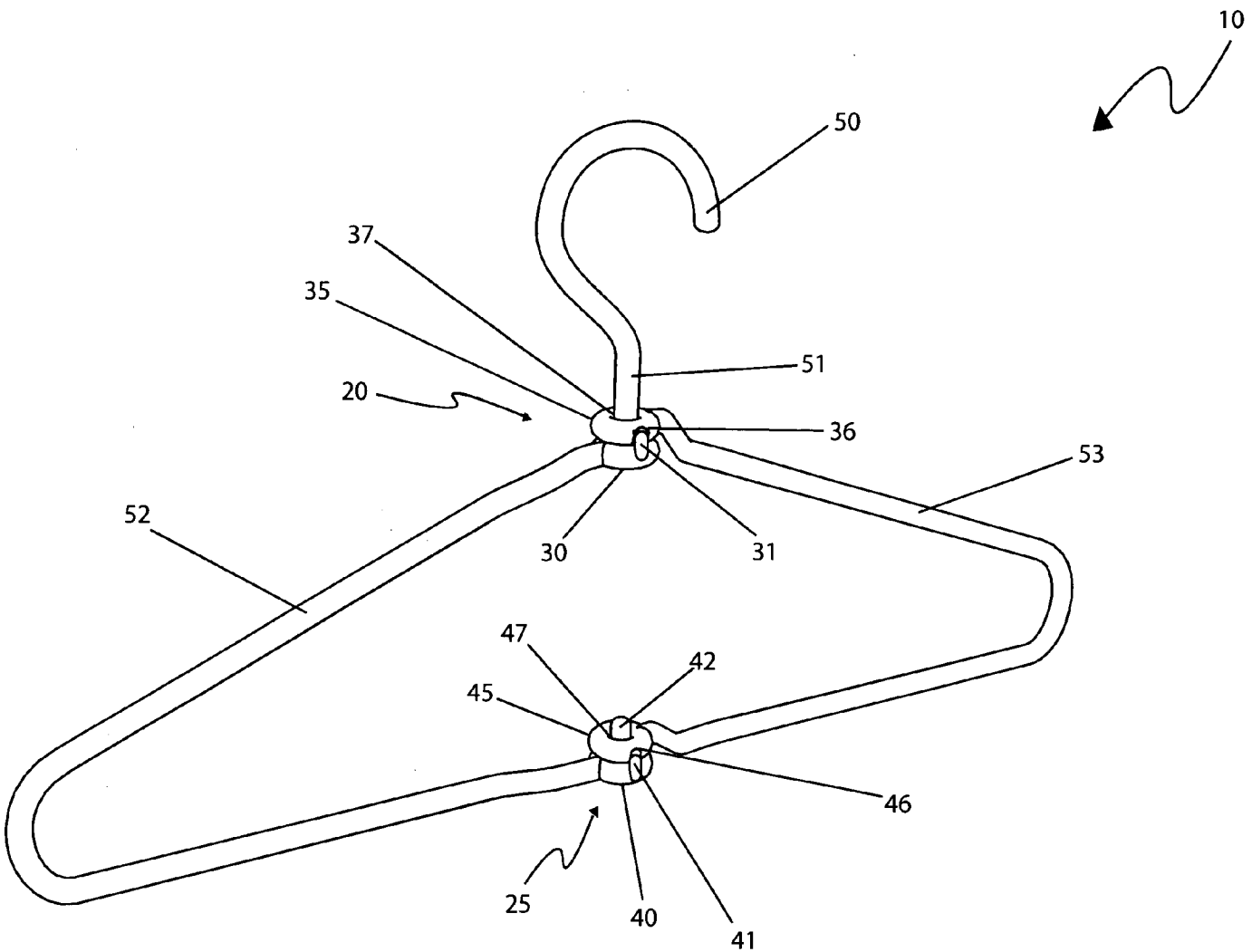
FIG. 1 is a perspective view of a collapsible travel hanger 10 in a deployed state, according to a preferred embodiment of the present invention.
Figure 2:
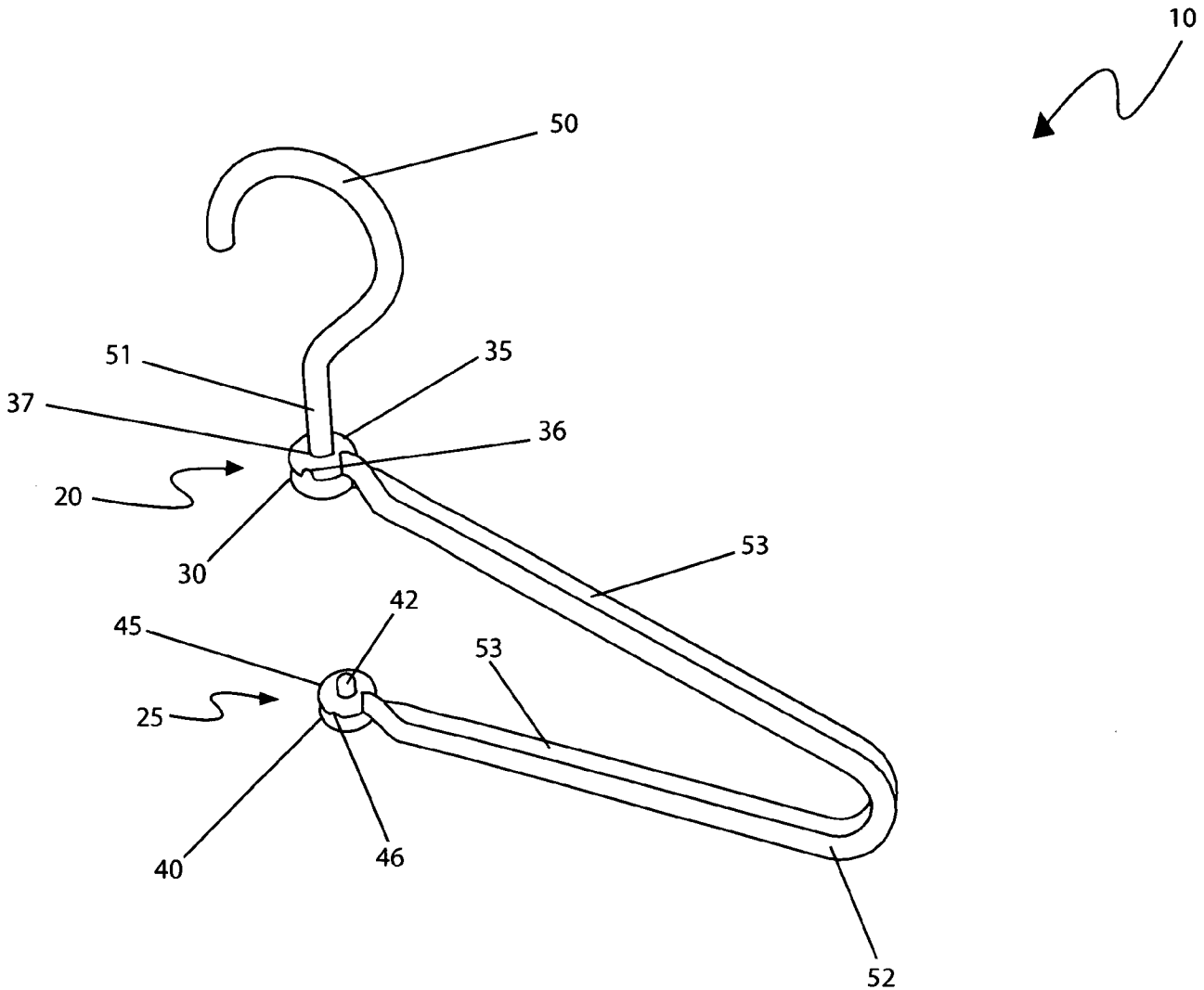
FIG. 2 is a perspective view of a collapsible travel hanger 10 in a collapsed state, according to a preferred embodiment of the present invention.
Figure 3:
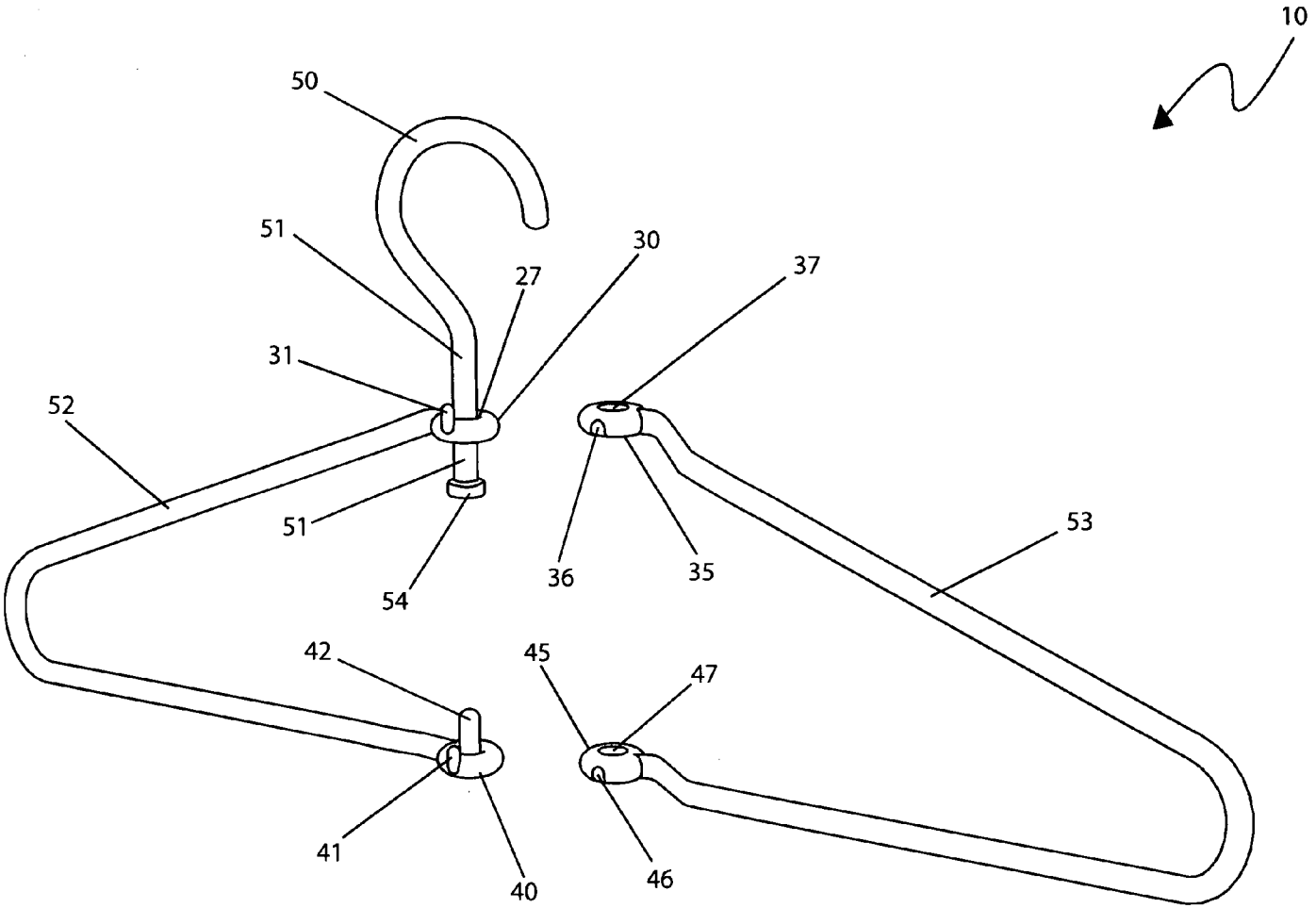
FIG. 3 is an exploded view of a collapsible travel hanger 10, according to a preferred embodiment of the present invention; and, FIG. 4 is a perspective view of a collapsible travel hanger 10, according to an alternate embodiment of the present invention.
Figure 4:
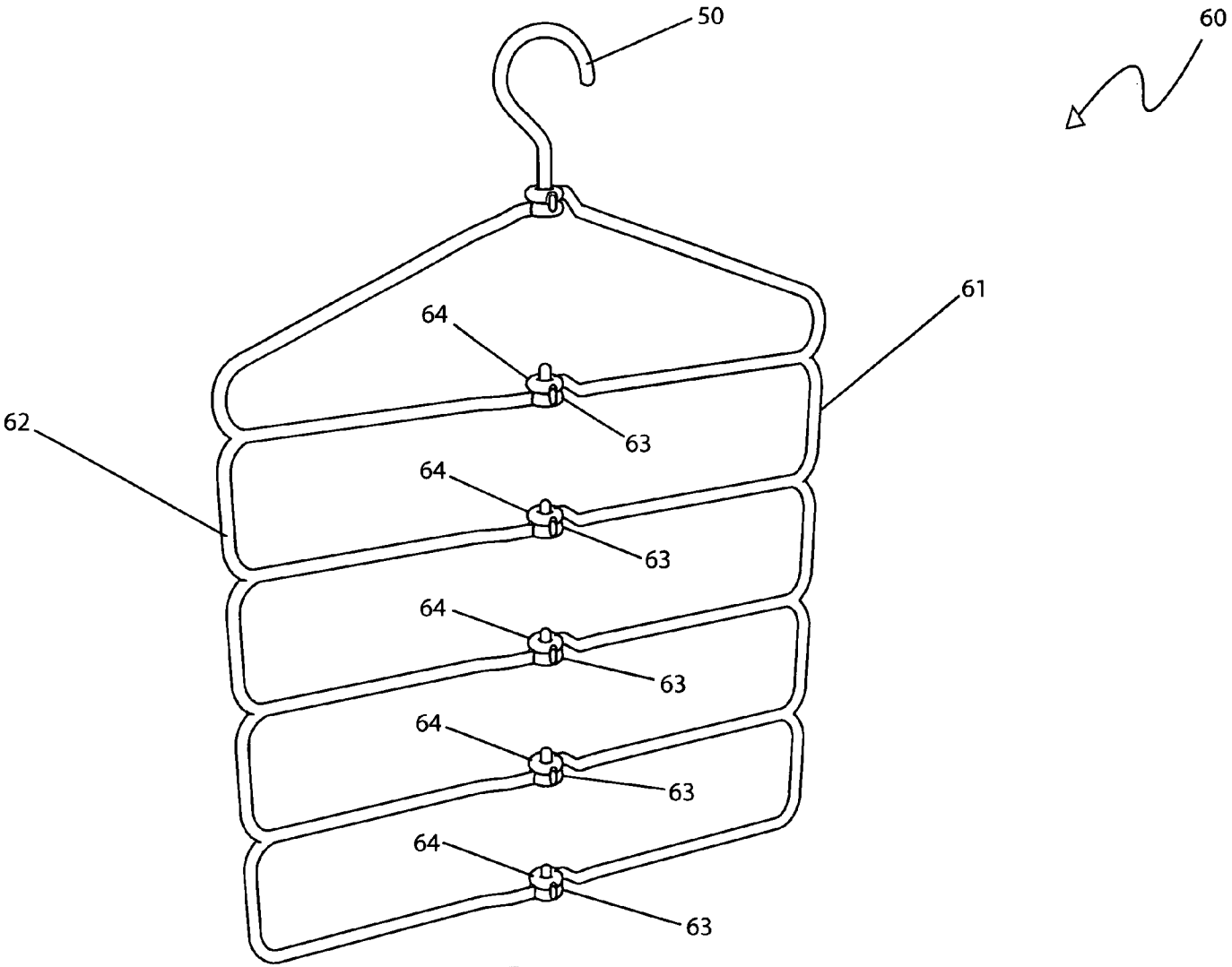

The best mode for carrying out the invention is presented in terms of its preferred embodiment, herein depicted within FIG. 1 through 3; and in terms of an alternate embodiment in FIG. 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a collapsible travel hanger (herein described as the "device") 10, which provides a means for a collapsible clothes hanger with an overall triangular shape, a "J"-shaped hook 50 on top, and upper and lower segments comprising integral pivoting hinges 20, 25 allowing the device 10 to fold in half to a collapsed state. In this manner, the invention 10 is ideal for travel, as it can be easily stowed in a suitcase. The pivot portions 20, 25 of the device 10 provide molded-in appendages 31, 41 and detent features 36, 46 to secure a rotary position once the device 10 is extended.

Referring now to FIG. 1, a perspective view of the device 10 in a deployed state, according to a preferred embodiment of the present invention, is disclosed. The device 10 comprises a first hinge assembly 20, a second hinge assembly 25, a hook 50, a shaft 51, a first loop 52, and a second loop 53. The device 10 provides a clothes support means similar to a conventional plastic clothes hanger comprising a generally triangular shape made up of the hook 50, the shaft 51 and the loops 52, 53 in an expected form. The first 52 and second 53 loops provide a hinging attachment thereto one another at an upper and lower position via a first hinge assembly 20 and a second hinge assembly 30, respectively.

The first hinge assembly 20 further comprises a first pivot member 30 and second pivot member 35 being integrally molded thereinto upper ends of the first 52 and second 53 loops, respectively. The first 30 and second 35 pivot members comprise a pair of torus-shaped features being stacked thereupon one another along a diametrical surface and aligned about a common vertical axis, the second pivot member 35 being located at an upper position thereupon. The first 30 and second 35 pivot members also provide a latching means thereto one another via a first pivot appendage 31 and a first pivot detent 36 along a perimeter edge providing compact collapsible storage and locking deployment of the device 10. The first pivot appendage 31 comprises a generally hemispherical protrusion projecting upward approximately one-quarter (¼) inch high and one-quarter (¼) inch in diameter. The first pivot detent 36 comprises a female feature which geometrically corresponds to the first pivot appendage 31 fitting snugly therewithin when the device 10 is in the deployed and extended state as shown here. The shaft 51 comprises a collapsing vertical rod-shaped member inserted slidingly therewithin a first pivot aperture 27 integrally molded thereon the first pivot member 30 at a top central location. The shaft 51 extends therefrom said first pivot member 30 in an upward direction therethrough the second pivot aperture 37 forming a vertical axel, thereby providing a horizontal locating means to the second pivot member 35 during use. The shaft 51 continues to extend in an upward direction forming an arcuate hook 50 taking a form similar to that of common clothes hangers.

The second hinge assembly 25 comprises a third pivot member 40 and a fourth pivot member 45 being integrally molded thereto lower ends of the first 52 and second 53 loops, respectively. The third 40 and fourth 45 pivot members comprise similar design and function as the first 30 and second 35 pivot member portions of the first hinge assembly 20. The third pivot member 40 comprises an integrally molded pivot post 42 which provides a vertical axle means to the fourth pivot member 45 via a third pivot aperture 47, thereby functioning in a similar manner as the shaft portion 51 of the first hinge assembly 20 and the second pivot aperture 37 as described above. It is further envisioned that the pivot post 42 may provide a snapping feature at a top location providing a secure attachment of the fourth pivot member 45 thereupon. In like manner, the third 40 and fourth 45 pivot members comprise a second pivot appendage 41 and interlocking second pivot detent 46, respectively, being of like design and function as the previously described first pivot appendage 31 and first pivot detent 36.

Referring now to FIG. 2, a perspective view of the device 10 in a collapsed state, according to a preferred embodiment of the present invention, is disclosed. The device 10 is illustrated here with the first loop 52 and hook 50 portions of the device 10 having been rotated one hundred-eighty degrees (180°) until adjacent to the second loop 53 as the corresponding second loop 53 remains stationary providing a flat configuration thereto the device 10, thereby allowing convenient storage within a suitcase or other travel container.

Referring now to FIG. 3, an exploded view of the device 10, according to a preferred embodiment of the present invention, is disclosed. The device 10 comprises a removably attachable 3-piece assembly envisioned being made of a durable plastic material such as polypropylene, polyethylene, polyvinyl chloride (PVC), or the like and being manufactured in a plastic injection molding process common in the industry. The device 10 is illustrated here showing the shaft 51 in a lowered or collapsed position, thereby, providing a compact storage means. The shaft 51 further comprises an integrally molded shaft lock feature 54 at a bottom end thereof. The shaft lock feature 54 comprises a cylindrical form providing a vertical and rotary positioning means to the shaft 51 and hook 50 when extended upward during use. It is envisioned that the shaft lock feature 54 is to fit snuggly therewithin a corresponding female feature along a lower surface of the first pivot member 30.

Referring now to FIG. 4, a perspective view of a multiple hanger embodiment 60, according to an alternate embodiment of the present invention, is disclosed. The multiple hanger embodiment 60 comprises a first multiple loop 61, a second multiple loop 62, a plurality of lower pivot members 63 and a plurality of upper pivot members 64. The multiple hanger embodiment 60 is envisioned being particularly suited to hanging a plurality personal clothing articles such as pants or the like thereupon in conjunction with a single jacket or shirt. The first 61 and second 62 multiple loops are envisioned to be similar to the aforementioned first 52 and second 53 loops further comprising additional attachments thereto lower horizontal rung portions. The multiple hanger embodiment 60 shown here illustrates a five (5) rung configuration; however, the multiple hanger embodiment 60 may be provided with any number rungs without deviating from the basic concept and as such should not be interpreted as a limiting factor. The multiple hanger embodiment 60 is envisioned to provide similar locking and folding functionality as the preferred embodiment 10. The multiple hanger embodiment 60 is further envisioned being made using similar materials and processes as the preferred embodiment 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the preferred embodiment of the device 10 may be achieved by performing the following steps: assembling the device 10, if not previously assembled, by inserting the hook portion 50 therein the second pivot aperture 37; inserting the pivot post 42 therein the third pivot aperture 47; storing one (1) or more devices 10 in a collapsed state within one's suitcase or other travel container until reaching one's destination; deploying the device 10 by rotating the first 52 and second 53 loops into a planar relationship; engaging the first 31 and second 41 pivot appendages therein the first 36 and second 46 pivot detents, respectively, to secure the device 10 in the deployed state; hanging personal clothing articles such as a shirt , jacket, or the like over the device 10; hanging additional clothing articles such as pants thereonto a lower portion of said loops 52, 53; dispensing clothing articles in an expected manner as needed; collapsing the device 10 for storage purposes by lifting the second loop 53 to disengage the first 31 and second 41 pivot appendages therefrom the first 36 and second 46 pivot detents, respectively, and pivoting the first loop portion 52 horizontally until in contact with said second loop 53; storing the device 10 in a suitcase or other travel container until needed again; and, benefiting from the compact storage capability of the device 10, or multiple devices 10, afforded a user while traveling.

The method of utilizing the alternate multiple hanger embodiment 60 may be achieved by performing the following steps: assembling and deploying the alternate embodiment 60 in a similar manner as the preferred embodiment 10; hanging additional clothing articles upon the first 61 and second 62 multiple loops such as pants, or the like, as desired; collapsing and storing the alternate embodiment 60 as previously described.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A collapsible travel hanger for storage in a suitcase, said travel hanger comprising:

a hook and a shaft formed therewith;

a first loop including a first hinge assembly engaged therewith, said first hinge assembly further comprising:

a first pivot member connected to an upper end of said first loop;

a second pivot member connected to an upper end of a second loop, said first and second pivot members being positioned about said shaft and freely rotatably thereabout respectively, said first and second pivot members being vertically stacked upon each other while concentrically disposed about said shaft, said second pivot member being located on top of said first pivot member;

a first pivot appendage protruding outwardly from said first pivot member; and, a first pivot detent formed along a perimeter edge of said second pivot member;

wherein said first pivot appendage has a protrusion projecting upwardly therefrom, said first pivot detent geometrically corresponding to said first pivot appendage such that said first pivot appendage snugly interfits therein;

said second loop including a second hinge assembly spaced from said first hinge assembly and engaged with said first and second loops respectively;

wherein said first and second hinge assemblies cooperate with each other for pivotally latching said first loop to said second loop and thereby permitting said first and second loops to remain rotatably interlocked while adapted between folded and unfolded positions.

2. The travel hanger of claim 1, wherein said shaft forms a vertical axle when positioned through said first and second pivot members of said first hinge assembly.

3. The travel hanger of claim 2, wherein said second hinge assembly comprises:

a third pivot member connected to a lower end of said first loop; and, a fourth pivot member connected to a lower end of said second loop;

said third pivot member including a rectilinear pivot post protruding upwardly therefrom and along a vertical plane to thereby create a vertical axle;

said fourth pivot member being concentrically seated about said pivot post and freely rotatable thereabout;

wherein said third and fourth pivot members have a second pivot appendage and a second pivot detent removably interlocked therewith respectively such that said third and fourth pivot members remain at substantially stable positions during rotating procedures.

4. The travel hanger of claim 1, wherein said first and second loops are contiguously abutted against each other after one of said first and second loops is articulated approximately one hundred-eighty degrees (180°) about said vertical axis.

5. The travel hanger of claim 1, wherein said shaft comprises:

an integrally molded shaft lock formed at a bottom end thereof such that said second pivot member rests on said shaft lock during folding operations.

6. The travel hanger of claim 1, further comprising:

at least one additional said first loop attached to said first loop;

at least one additional said second loop attached to said second loop;

at least one additional said first hinge assembly attached to said at least one additional first and second loops; and, at least one additional said second hinge assembly attached to said at least one additional said first hinge assembly.

7. A collapsible travel hanger for storage in a suitcase, said travel hanger comprising:

a hook and a shaft monolithically formed therewith;

a first loop including a first hinge assembly engaged therewith, said first hinge assembly further comprising:

a first pivot member connected to an upper end of said first loop;

a second pivot member connected to an upper end of a second loop, said first and second pivot members being positioned about said shaft and freely rotatably thereabout respectively, said first and second pivot members being vertically stacked upon each other while concentrically disposed about said shaft, said second pivot member being located on top of said first pivot member;

a first pivot appendage protruding outwardly from said first pivot member; and, a first pivot detent formed along a perimeter edge of said second pivot member;

wherein said first pivot appendage has a protrusion projecting upwardly therefrom, said first pivot detent geometrically corresponding to said first pivot appendage such that said first pivot appendage snugly interfits therein;

said second loop including a second hinge assembly spaced from said first hinge assembly and engaged with said first and second loops respectively;

wherein said first and second hinge assemblies cooperate with each other for pivotally latching said first loop to said second loop and thereby permitting said first and second loops to remain rotatably interlocked while adapted between folded and unfolded positions; and, wherein said first hinge assembly is further connected to said second loop.

8. The travel hanger of claim 7, wherein said shaft forms a vertical axle when positioned through said first and second pivot members of said first hinge assembly.

9. The travel hanger of claim 8, wherein said second hinge assembly comprises:

a third pivot member connected to a lower end of said first loop; and, a fourth pivot member connected to a lower end of said second loop;

said third pivot member including a rectilinear pivot post protruding upwardly therefrom and along a vertical plane to thereby create a vertical axle;

said fourth pivot member being concentrically seated about said pivot post and freely rotatable thereabout;

wherein said third and fourth pivot members have a second pivot appendage and a second pivot detent removably interlocked therewith respectively such that said third and fourth pivot members remain at substantially stable positions during rotating procedures.

10. The travel hanger of claim 7, wherein said first and second loops are contiguously abutted against each other after one of said first and second loops is articulated approximately one hundred-eighty degrees (180°) about said vertical axis.

11. The travel hanger of claim 7, wherein said shaft comprises: an integrally molded shaft lock formed at a bottom end thereof such that said second pivot member rests on said shaft lock during folding operations.

12. The travel hanger of claim 7, further comprising:

at least one additional said first loop attached to said first loop;

at least one additional said second loop attached to said second loop;

at least one additional said first hinge assembly attached to said at least one additional first and second loops; and, at least one additional said second hinge assembly attached to said at least one additional said first hinge assembly.

* * * * *